US006343943B1

(12) United States Patent
Shen

(10) Patent No.: US 6,343,943 B1
(45) Date of Patent: Feb. 5, 2002

(54) TRACK CONNECTOR OF TRACK LIGHTING

(76) Inventor: Wei Hong Shen, 6F, No. 649-9, Chung Cheng Rd., Hsinchuang City, Taipei Hsien (TW)

( * ) Notice: Subject to any disclaimer, the term of this patent is extended or adjusted under 35 U.S.C. 154(b) by 0 days.

(21) Appl. No.: 09/912,381

(22) Filed: Jul. 26, 2001

(51) Int. Cl.[7] ..... H01R 25/00
(52) U.S. Cl. ..... 439/115
(58) Field of Search ..... 439/115, 210, 439/213, 628; 362/404

(56) References Cited

U.S. PATENT DOCUMENTS 4,053,194 A * 10/1977 Gilman ..... 439/115
5,341,276 A * 8/1994 Shen ..... 439/110
6,093,037 A * 7/2000 Lin ..... 439/115

* cited by examiner

*Primary Examiner*—Renee Luebke
*Assistant Examiner*—Briggitte R. Hammond
(74) *Attorney, Agent, or Firm*—Rabin & Berdo, P.C.

(57) ABSTRACT

A track connector for track lighting mainly comprises a conductive coupler, an insulative shell and at least one flexible conductive shaft assembled to the conductive bushing corresponding to the coupling rail. The conductive coupler has a through hole and at least one coupling rail extending from one end of the through hole. The coupling rail is formed with a locking hole and a locking member is screwed into the locking hole to lock a track of the track lighting with the coupling rail. The tracks of the track lightings are assembled to the coupling rails of the conductive coupler and the electric power is conducted through the conductive coupler and the flexible conductive shaft.

12 Claims, 10 Drawing Sheets

TRACK CONNECTOR OF TRACK LIGHTING

FIELD OF THE INVENTION

The present invention relates to a track connector for track lighting, especially to a track connector for track lighting to interconnect at least two tracks of the track lighting.

BACKGROUND OF THE INVENTION

The lighting provides versatile functions for house decoration. Various lightings such as table lighting, desktop lighting, ceiling lamp and track lighting are extensively used.

FIG. 1 shows a perspective view of a prior art track lighting 11*a*, which is clamped to a track 10*a* on a ceiling la by two clamping pads 12*a*. The clamping pads 12*a* are slidable on the track 10*a*. The track 10*a* has two conductive strips 13*a* connected to an anode and a cathode of the track lighting 11*a*, respectively, to supply electric power to the track lighting 11*a*.

When the track lighting 11*a* is to be arranged on a corner of the ceiling 1*a*, two track lightings 11*a* and two respective tracks 10*a* are required to arranged on transverse and longitudinal sides of the corner. The two track lightings 11*a* require respective electric powers because the two respective tracks 10*a* are not connected. The wiring is difficult and the maintenance is cumbersome if two respective tracks 10*a* are connected.

SUMMARY OF THE INVENTION

It is an object of the present invention to provide a track connector for track lighting such that a plurality of tracks can be assembled to each other and electric power is communicated with the tracks.

It is another object of the present invention to provide a track connector for track lighting such that a plurality of tracks can be assembled to each other and the angle therebetween can be freely adjusted.

To achieve above object, the present invention provides a track connector for track lighting mainly having a conductive coupler, an insulative shell and at least one flexible conductive shaft assembled to the conductive bushing corresponding to the coupling rail. The conductive coupler has a through hole and at least one coupling rail extending from one end of the through hole. The coupling rail is formed with a locking hole and a locking member is screwed into the locking hole to lock a track of the track lighting with the coupling rail. The tracks of the track lightings are assembled to the coupling rails of the conductive coupler and the electric power is conducted through the conductive coupler and the flexible conductive shaft.

Moreover, the conductive coupler can be formed by pivotally assembling two coupling rails and the coupling rails can be rotated with each other. Therefore, the tracks can be arranged along arbitrary angles by adjusting the coupling rails.

The various objects and advantages of the present invention will be more readily understood from the following detailed description when read in conjunction with the appended drawing, in which:

DETAILED DESCRIPTION OF THE INVENTION

Figure 1:
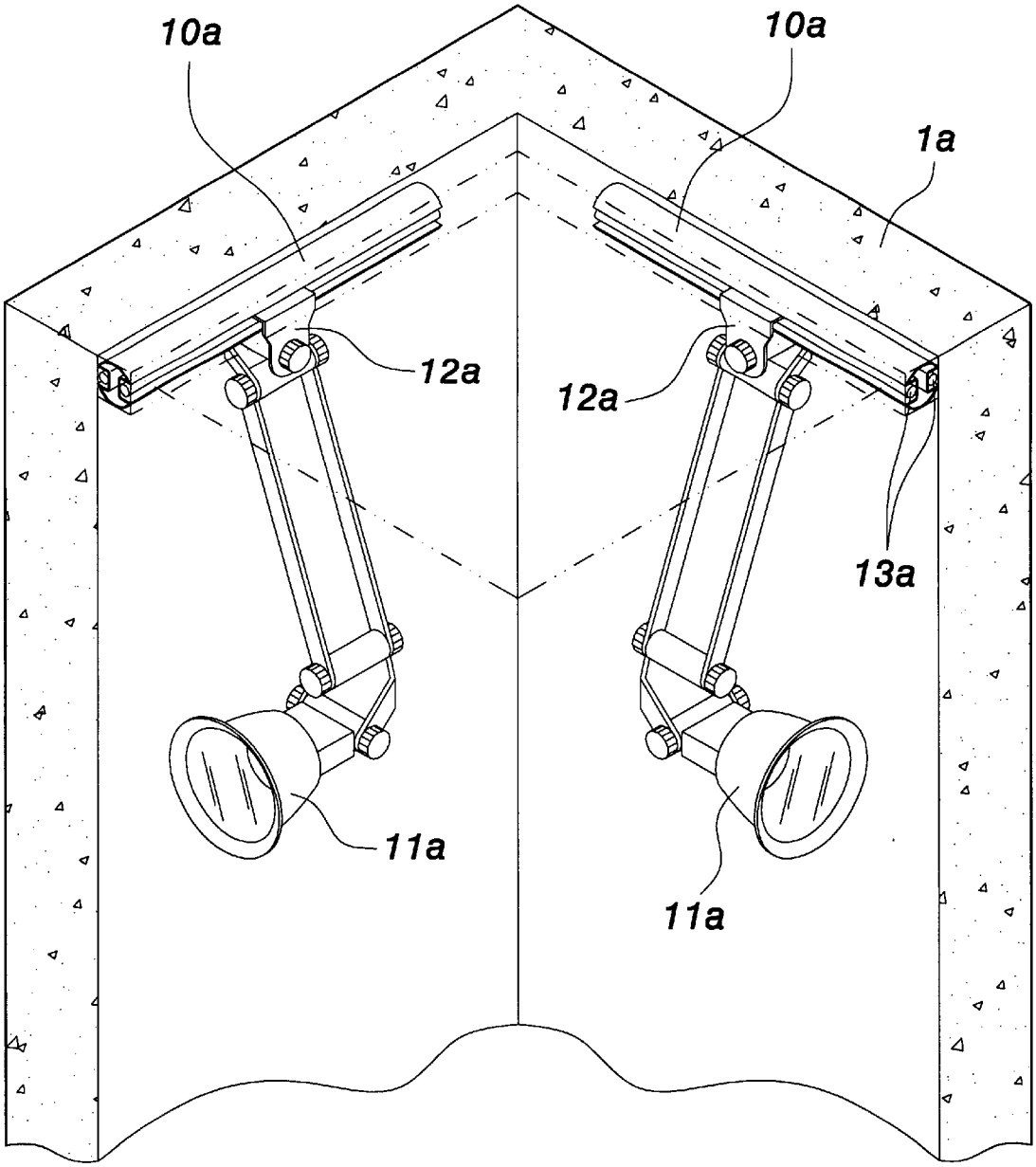
FIG. 1 PRIOR ART
FIG. 1 shows a perspective view of a prior art track lighting.
Figure 2:
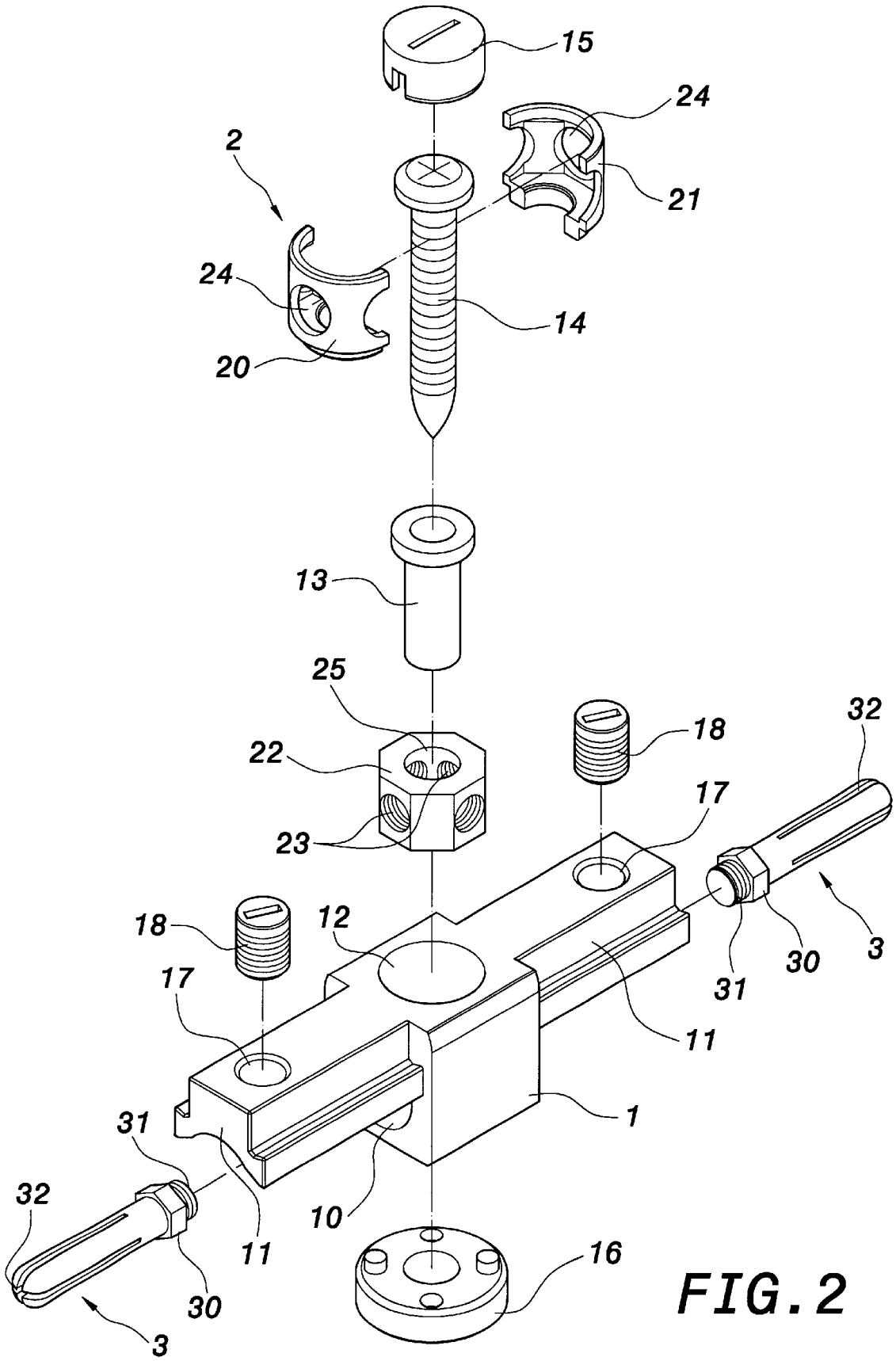
FIG. 2 shows an exploded view of the present invention.
Figure 3:
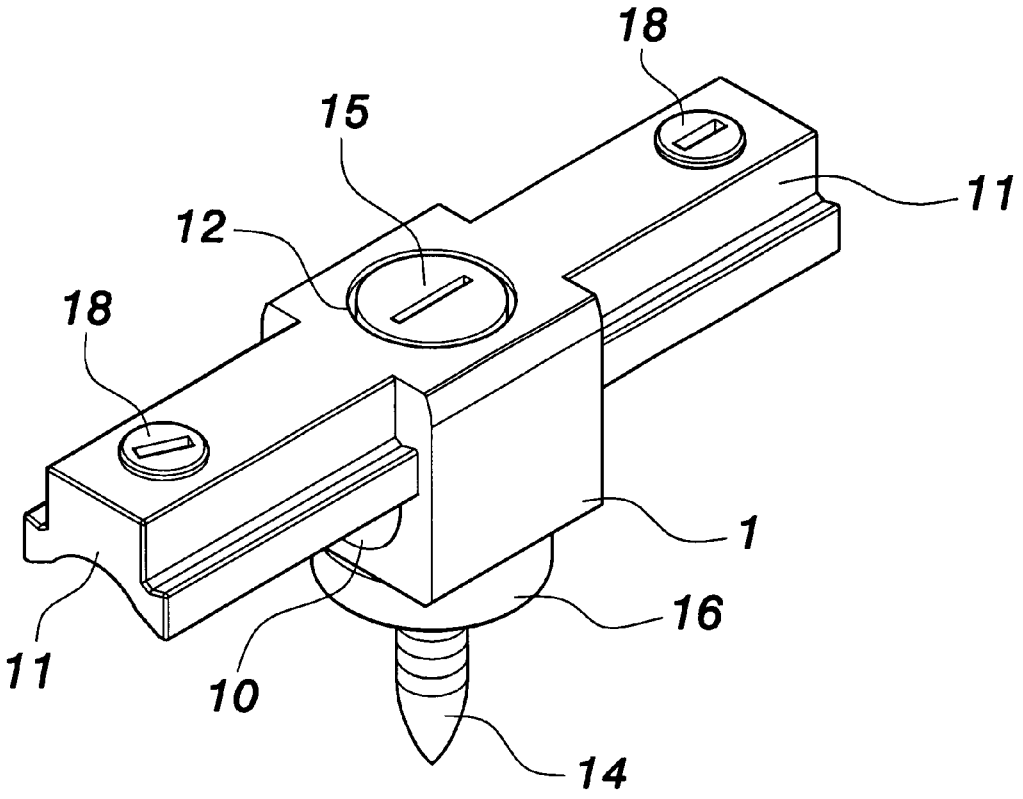
FIG. 3 shows a perspective view of the present invention.
Figure 4:
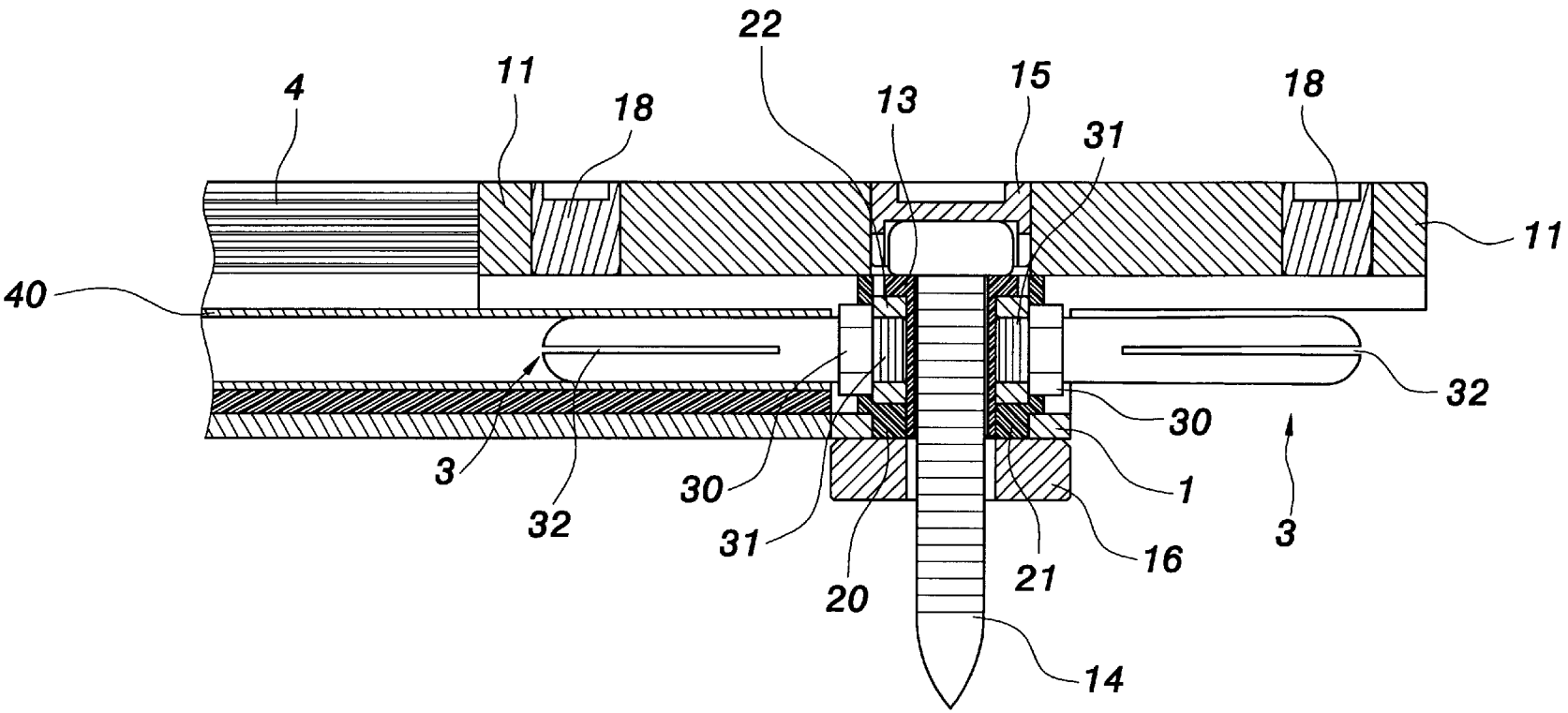
FIG. 4 shows a sectional view of the present invention.
Figure 5:
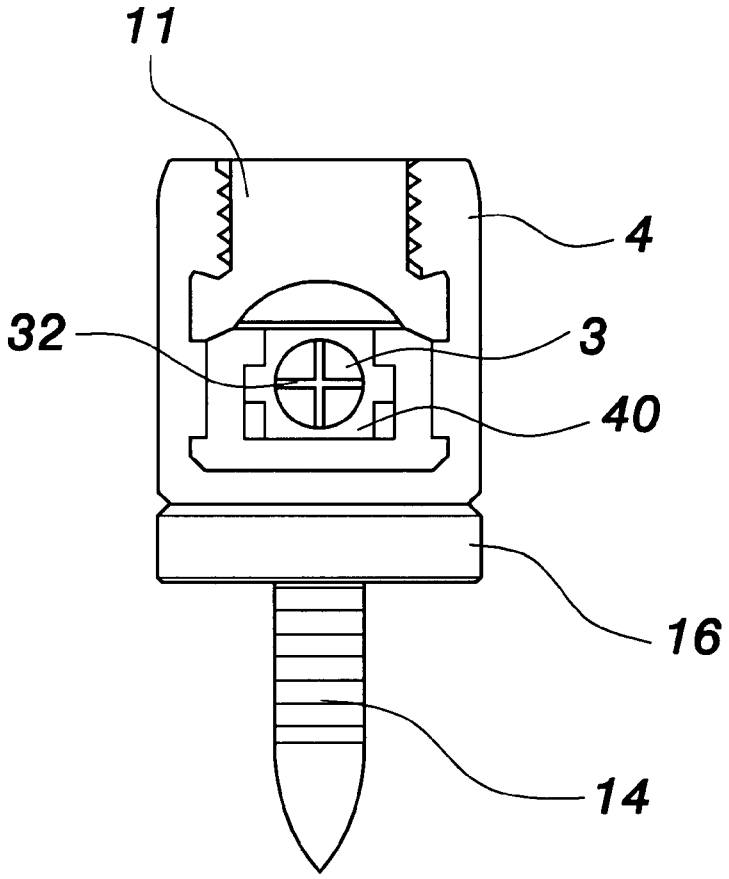
FIG. 5 shows a front view of the present invention.

FIG. 2 shows an exploded view of the present invention and FIG. 3 shows a perspective view of the present invention, respectively. The inventive track connector for track lighting mainly comprises a conductive coupler 1, an insulative shell 2 and a flexible conductive shaft 3. The conductive coupler 1 is made of conductive material and has a through hole 10 matched with the insulative shell 2. The conductive coupler 1 has two coupling rails 11 extending in opposite directions from both ends of the through hole 10. The coupling rail 11 can be assembled with a track 4 as shown in FIGS. 4 and 5.

The conductive coupler 1 has a clamping hole 12 communicating with the through hole 10 and a threaded sleeve 13 is placed within the clamping hole 12 whereby the conductive coupler 1 can be fixed by a screw 14 through the threaded sleeve 13. The screw 14 is shielded by a cover 15, and a padding 16 is provided at a bottom of the conductive coupler 1.

The coupling rail 11 is formed with a locking hole 17 and a locking member 18 is screwed into the locking hole 17 to lock the track 4 assembled with the coupling rail 11.

The insulative shell 2 is of hollow configuration and composed of two semi-shells 20 and 21. The insulative shell 2 encloses a conductive bushing 22 made of conductive material and has a plurality of threaded holes 23 matched with the flexible conductive shaft 3. The semi-shells 20 and 21 have a plurality of rounded holes 24 corresponding to the threaded holes 23 for receiving the flexible conductive shaft 3.

The conductive bushing 22 enclosed by the insulative shell 2 also has a positioning hole 25 corresponding to the clamping hole 12 of the conductive coupler 1 to position the threaded sleeve 13 to facilitate the screwing of the screw 14.

The flexible conductive shaft 3 is also made of conductive material and has a nut 30 on one end thereof. The nut 30, for example, can be a hexagonal nut and has outer thread 31 for screwing into the threaded hole 23. The flexible conductive shaft 3 has a bulgy portion on another end thereof and having a cruciform slit 32. The flexible conductive shaft 3 is assembled with a conductive strip 40 of the track 4, as shown in FIGS. 4 and 5.

Figure 6:
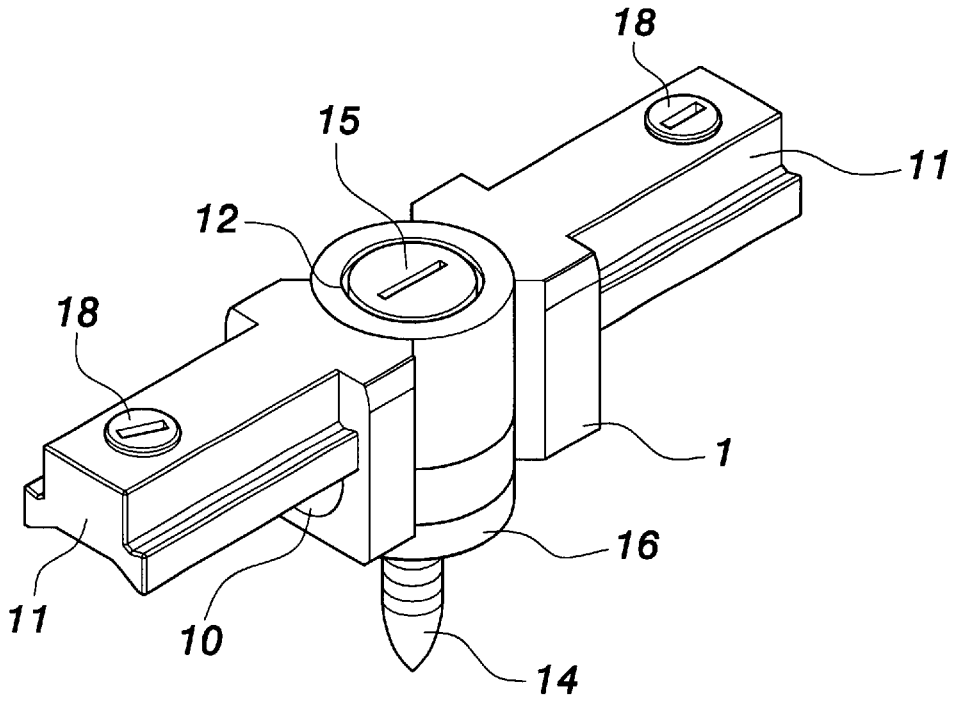
FIG. 6 shows a perspective view of the second preferred embodiment of the present invention.
Figure 7:
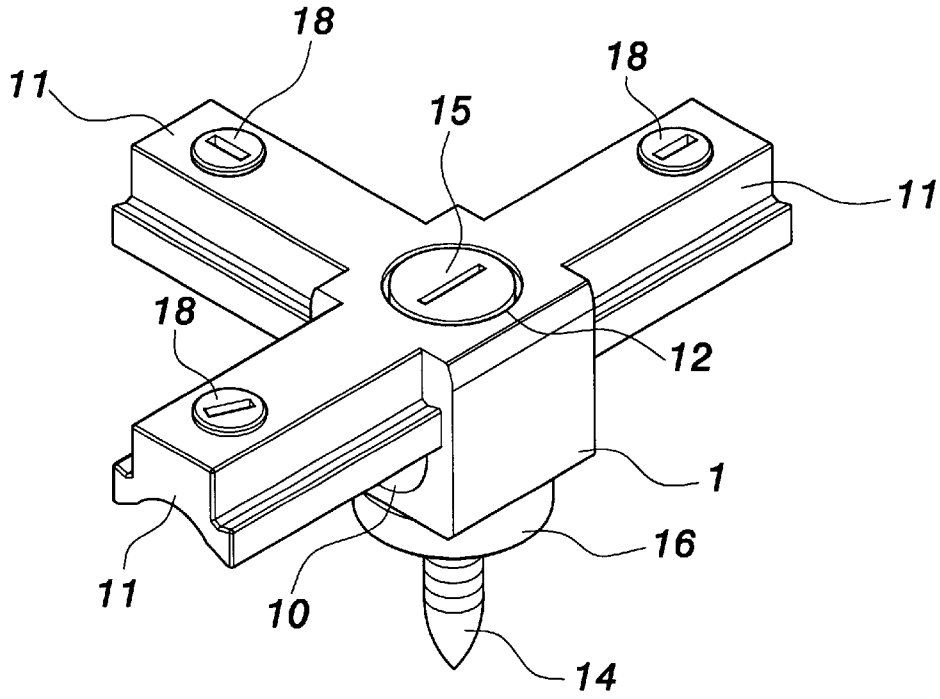
FIG. 7 shows a perspective view of the third preferred embodiment of the present invention.
Figure 8:
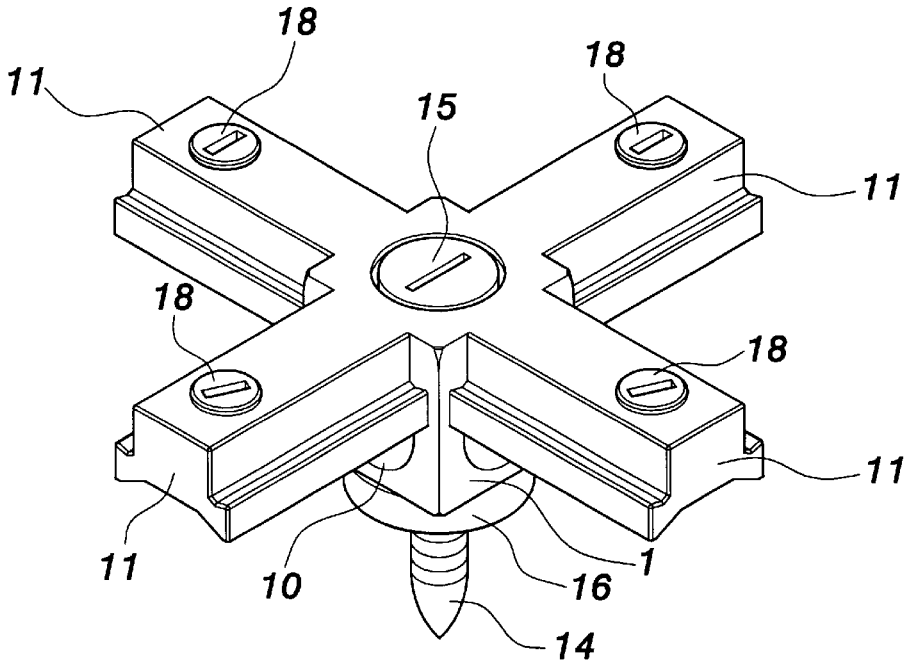
FIG. 8 shows a perspective view of the fourth preferred embodiment of the present invention.
Figure 9:
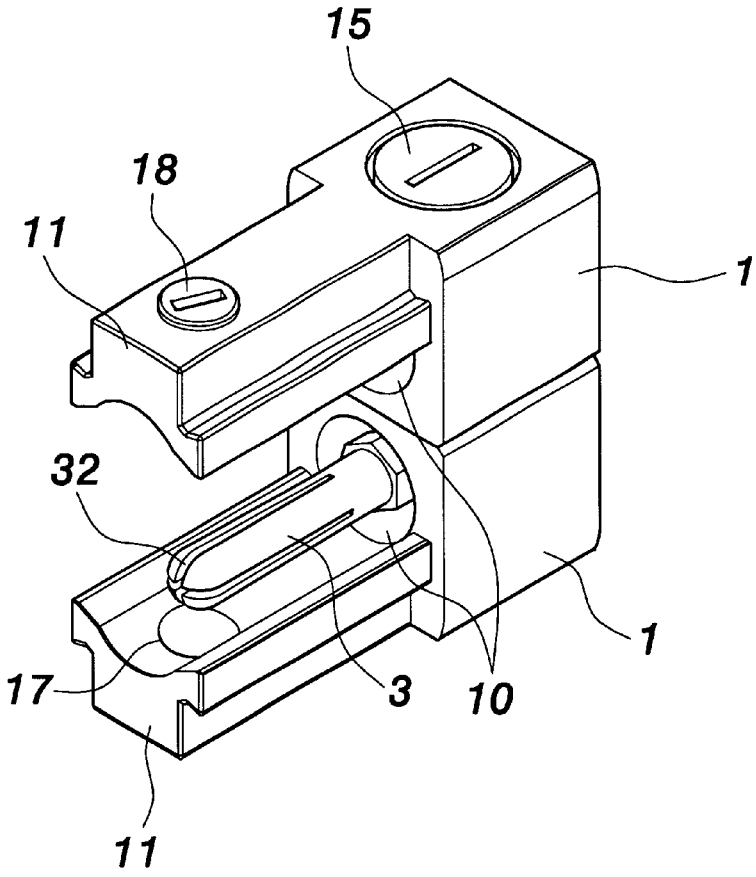
FIG. 9 shows a perspective view of the fifth preferred embodiment of the present invention.
Figure 10:
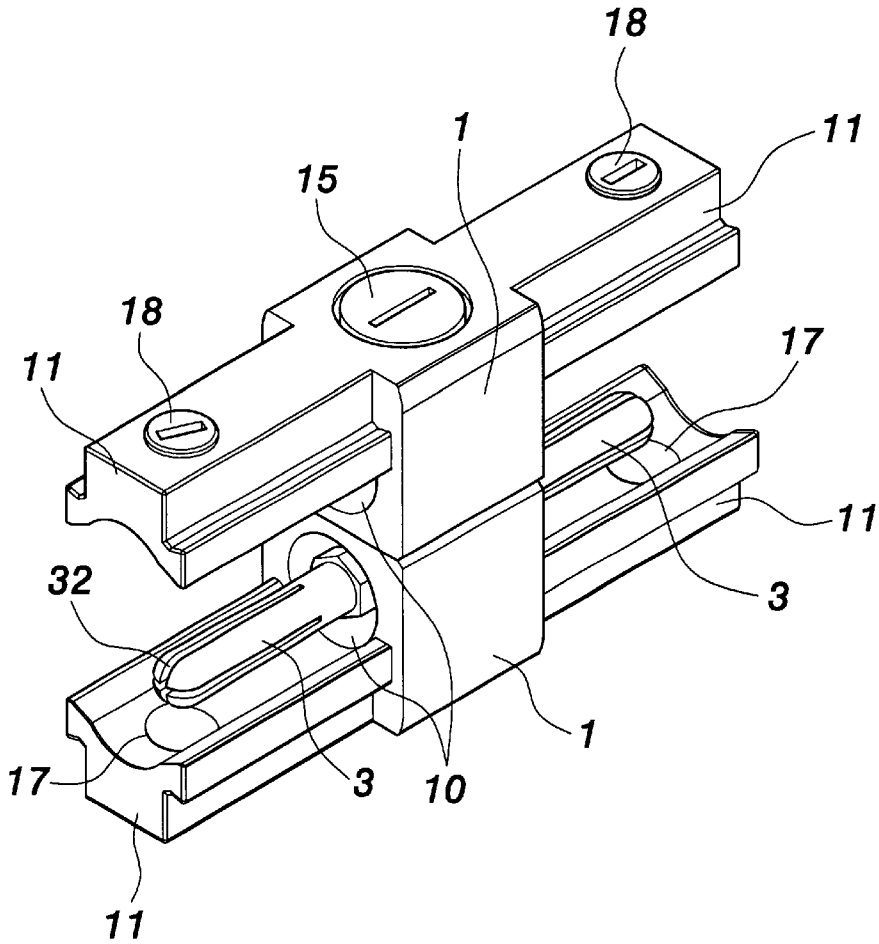
FIG. 10 shows a perspective view of the sixth preferred embodiment of the present invention.

With reference now to FIGS. 4 and 5, the coupling rail 11 on one end of the conductive coupler 1 is assembled with a track 4. The track 4 is functioned as an anode and electrically connected to another coupling rail 11 on the conductive coupler 1 through the conductive coupler 1. The conductive strip 40 is functioned as a cathode and electrically connected to the flexible conductive shaft 3, and another flexible conductive shaft 3 through the conductive bushing 22. Therefore, the two tracks 4 can be electrically connected to each other when they are assembled to the coupling rails 11 of the conductive coupler 1 and the electric power is transmitted through the conductive coupler 1 and the flexible conductive shaft 3. The conductive coupler 1 and the flexible conductive shaft 3 are isolated by the insulative shell 2 to prevent short circuit, Moreover, as shown in FIG. 6, the conductive coupler 1 can be formed by pivotally assembling two coupling rails 11 and the coupling rails 11 can be rotated with each other. Therefore, the tracks 4 can be arranged along arbitrary angles by adjusting the coupling rails 11.

Moreover, as shown in FIGS. 7 to 10, the number of the conductive coupler 1 can be increased according to the number of the tracks 4 to be assembled, and the conductive coupler 1 can be such arranged that the tracks 4 are arranged in parallel fashion.

Moreover, the track lighting uses electric voltage of 12 volt, which is not dangerous to human body. Therefore, the inventive track connector for track lighting does not have hazardous problem.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A track connector for track lighting mainly comprising a conductive coupler made of conductive material and having a through hole and at least one coupling rail extending from one end of the through hole;

an insulative shell arranged in the through hole and enclosing a conductive bushing, and at least one flexible conductive shaft made of conductive material and assembled to the conductive bushing corresponding to the coupling rail.

2. The track connector for track lighting as in claim 1, wherein the conductive coupler is formed by pivotally assembling a plurality of coupling rails such that the coupling rails can be rotated with respect to each other.

3. The track connector for track lighting as in claim 1, wherein a padding is provided at a bottom of the conductive coupler.

4. The track connector for track lighting as in claim 1, wherein the coupling rail is formed with a locking hole and a locking member is screwed into the locking hole to lock a track of the track lighting with the coupling rail.

5. The track connector for track lighting as in claim 1, wherein the conductive coupler has a clamping hole communicating with the through hole and a threaded sleeve is placed within the clamping hole whereby the conductive coupler can be fixed by a screw through the threaded sleeve.

6. The track connector for track lighting as in claim 5, wherein the conductive bushing enclosed by the insulative shell also has a positioning hole corresponding to the clamping hole of the conductive coupler to position the threaded sleeve and facilitate the screwing of the screw.

7. The track connector for track lighting as in claim 5, wherein the screw is shielded by a cover.

8. The track connector for track lighting as in claim 1, wherein the insulative shell is composed of two semi-shells.

9. The track connector for track lighting as in claim 1, wherein the conductive bushing has a plurality of threaded holes matched with the flexible conductive shaft.

10. The track connector for track lighting as in claim 1, wherein the flexible conductive shaft has a nut on one end thereof and the nut has outer thread for screwing into the threaded hole, the flexible conductive shaft has a bulgy portion on another end thereof and having slit.

11. The track connector for track lighting as in claim 10, wherein the nut is a hexagonal nut.

12. The track connector for track lighting as in claim 10, wherein the slit is of cruciform shape.

* * * * *